US005873526A

United States Patent [19]

Cooke

[11] Patent Number: 5,873,526

[45] Date of Patent: Feb. 23, 1999

[54] INJECTION NOZZLE

[75] Inventor: Michael Peter Cooke, Gillingham, England

[73] Assignee: Lucas Industries public limited, England

[21] Appl. No.: 808,342

[22] Filed: Feb. 28, 1997

[30] Foreign Application Priority Data

Mar. 30, 1996 [GB] United Kingdom ..... 9606803

[51] Int. Cl.[6] ..... F02M 47/02

[52] U.S. Cl. ..... 239/88; 239/96; 239/533.5

[58] Field of Search ..... 239/88, 95, 96, 239/533.5

[56] References Cited

U.S. PATENT DOCUMENTS

| | | | |
|---|---|---|---|
| 3,592,392 | 7/1971 | Huber | 239/585.3 |
| 4,572,433 | 2/1986 | Deckard | 239/96 X |
| 5,265,804 | 11/1993 | Brunel | 239/88 |
| 5,441,029 | 8/1995 | Hlousek | 239/96 X |
| 5,472,142 | 12/1995 | Iwanaga | 239/96 |
| 5,671,715 | 9/1997 | Tsuzuki | 239/96 X |

FOREIGN PATENT DOCUMENTS

| | | |
|---|---|---|
| 4243674 | 6/1994 | Germany . |
| 686763 | 12/1995 | Germany . |
| 661442 | 7/1995 | Italy . |
| 1132403 | 10/1968 | United Kingdom . |
| 174083 | 3/1986 | United Kingdom . |

*Primary Examiner*—Lesley D. Morris
*Attorney, Agent, or Firm*—Trexler, Bushnell, Giangiorgi & Blackstone, Ltd.

[57] ABSTRACT

An injection nozzle comprises a valve needle engageable with a seating. The needle includes a surface arranged such that when the needle occupies a fully lifted position, part of the surface is exposed to the fuel pressure within a control chamber whilst a second part of the surface is exposed to the fuel pressure within a second chamber. Independent restricted passages provide communication between the control and second chambers and a supply line. A control valve communicates with the second chamber to control operation of the injection nozzle. The control valve is actuated by an electromagnetic actuator having a core arrangement—armature air gap of tapering axial length.

7 Claims, 2 Drawing Sheets

INJECTION NOZZLE

Figure 1:
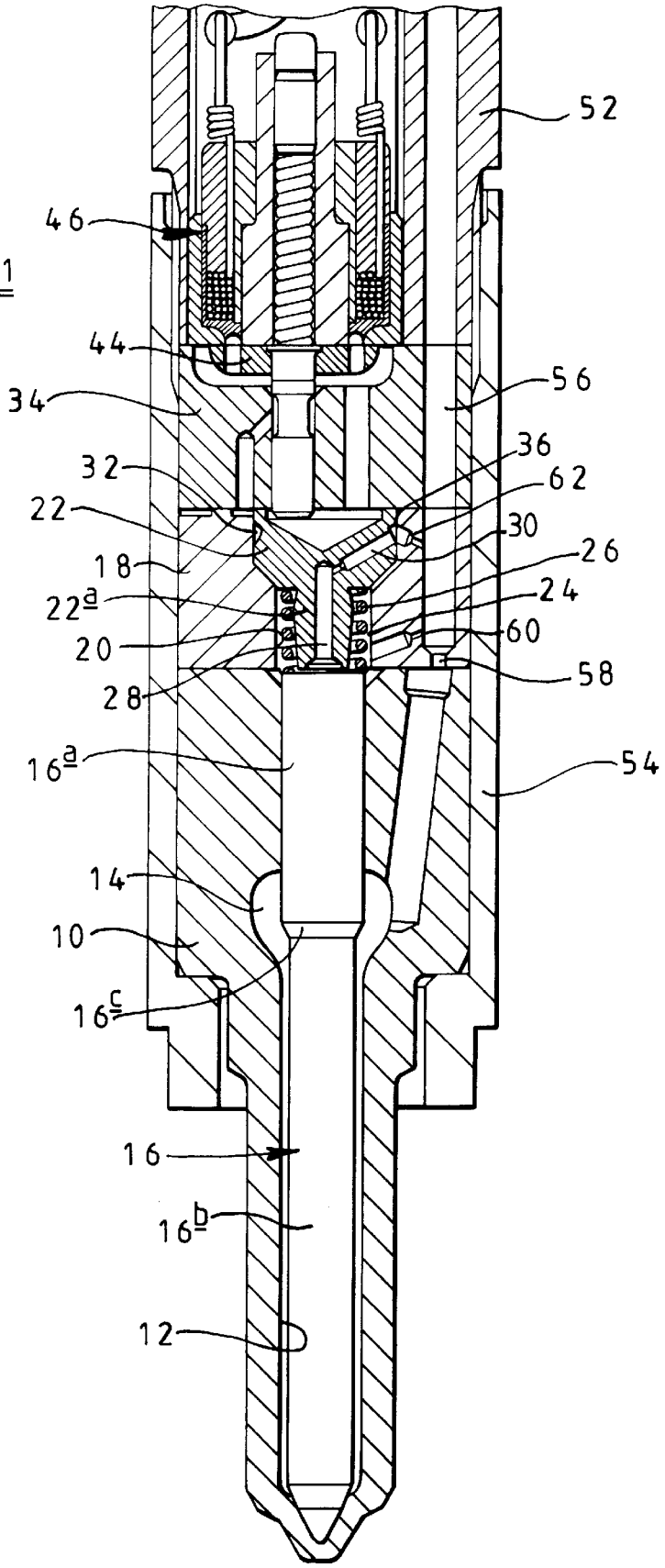

This invention relates to an injection nozzle for use in the supply of fuel to a cylinder of an internal combustion engine. In particular, this invention relates to an injection nozzle including a valve needle which is engageable with a seating, the position of the valve needle being controlled by an electromagnetic actuator arrangement.

An existing injection nozzle arrangement includes a valve needle which is slidable within a blind bore one end of which defines a seating with which the valve needle is engageable to control the delivery of fuel from one or more openings provided in the blind end of the bore. High pressure fuel is applied to the valve needle, the action of the high pressure fuel on angled surfaces of the valve needle tending to lift the valve needle from its seating. A spring located within a spring chamber acts against the end of the valve needle remote from the seating urging the valve needle into engagement with the seating. The spring chamber is arranged to be supplied with high pressure fuel through a restrictor, and a solenoid actuated valve controls the flow of fuel from the spring chamber to a suitable low pressure drain.

In use, in order to commence injection the solenoid actuated valve is operated to permit fuel from the spring chamber to flow to the drain. The restrictor only permits a low rate of fuel supply to the spring chamber, thus the fuel pressure within the spring chamber falls. The reduction in pressure in the spring chamber is sufficient to enable the pressure acting against the angled surfaces of the valve needle to lift the valve needle from its seating and permit fuel flow past the seating to the or each opening.

Termination of injection is achieved by closing the solenoid actuated valve, the fuel pressure within the spring chamber then increasing due to the flow of fuel into the spring chamber through the restrictor. The fuel pressure rises to a sufficiently high value that the combined effect of the fuel pressure and the spring is sufficient to return the valve needle into engagement with the seating against the action of the high pressure fuel against the angled surfaces of the valve needle.

It is an object of the invention to provide an improved injection nozzle of the type described hereinbefore.

According to a first aspect of the invention there is provided an injection nozzle comprising a valve needle engageable with a seating, the needle including a thrust surface to which fuel under pressure can be applied to lift the needle away from the seating, the valve needle having a surface associated therewith arranged such that, when the valve needle occupies a fully lifted position, a first part of the surface is exposed to the fuel pressure within a control chamber whilst a second part of the surface is exposed to the fuel pressure within a second chamber, wherein the control chamber communicates with a supply line through a first restricted passage and the second chamber communicates with the supply line through a second restricted passage independent of the first restricted passage.

The second restricted passage is conveniently composed of a pair of orifices connected in series.

According to a second aspect of the invention there is provided an injection nozzle comprising a valve needle engageable with a seating, the needle including a thrust surface to which fuel under pressure can be applied to lift the needle away from the seating, the valve needle having a surface associated therewith exposed to the fuel pressure within a control chamber, the fuel pressure within the control chamber being controlled by an electromagnetically actuated valve comprising a solenoid actuator having a core arrangement and an armature, an air gap being defined between the core arrangement and the armature, wherein the axial length of the air gap tapers from a maximum adjacent an edge of the armature to a minimum adjacent the centre thereof.

The provision of such a tapering air gap enables the effective gap between the core arrangement and armature to be reduced and thus permits an increase in the force available.

It will be appreciated that, in practice, the air gap may be filled with fuel.

The invention also relates to a solenoid actuator suitable for use in an injection nozzle in accordance with the second aspect of the invention.

The injection nozzle may further comprise a distance piece provided with a through bore, an insert being provided in the through bore, the distance piece and insert defining, in part, the control chamber.

According to a further aspect of the invention there is provided a control valve comprising a valve member slidable within a bore, the valve member including a region of enlarged diameter which is engageable with a seating defined around an end part of the bore, and a region of reduced diameter upstream of the seating, the region of reduced diameter defining, with the bore, an annular chamber which communicates with a valve inlet port.

It will be appreciated that when the valve member engages its seating, fuel is unable to flow from the inlet port through the annular chamber and escape from the bore, such flow being permitted when the valve member is lifted from its seating. Further, as the seating is defined around the bore, the seating diameter is substantially equal to the bore diameter thus the valve member is substantially pressure balanced when in engagement with its seating.

Figure 2:
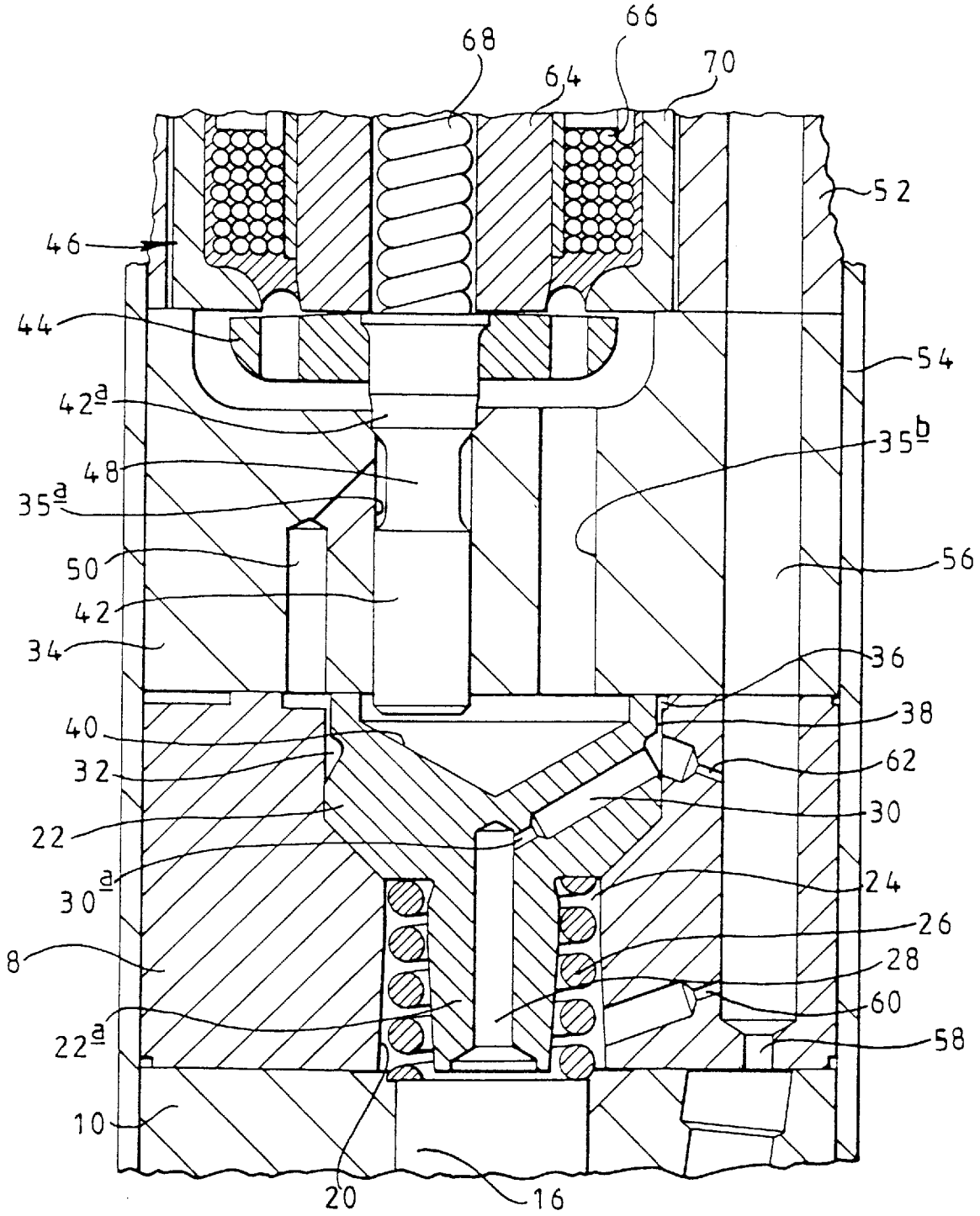

The invention will further be described, by way of example, with reference to the accompanying drawings, in which:

FIG. 1 is a cross-sectional view of part of an injection nozzle in accordance with an embodiment of the invention; and FIG. 2 is an enlarged view of part of FIG. 1.

The injection nozzle illustrated in the accompanying drawings comprises a nozzle body 10 within which a blind bore 12 is provided. Part way along the blind bore 12, an annular gallery 14 is formed, and adjacent the blind end of the bore 12, a substantially conical seating area is formed. The blind end of the bore 12 communicates with small openings (not shown) in a conventional manner.

A valve needle 16 is slidable within the blind bore 12, the valve needle 16 including a first region 16*a* of diameter substantially equal to the diameter of the bore 12 so as to form a substantially fluid tight seal therewith and a reduced diameter second region 16*b* permitting fuel to flow between the valve needle 16 and nozzle body 10, the interconnection between the first and second regions 16*a*, 16*b* taking the form of an angled thrust surface 16*c* located within the annular gallery 14. The end of the valve needle 16 adjacent the blind end of the bore 12 is shaped so as to take conical form and is engageable with the seating so as to form a substantially fluid tight seal therewith. The exposed part of the end of the valve needle also acts as a thrust surface.

The end of the valve body 10 remote from the blind end of the bore 12 abuts a first distance piece 18 which is provided with a through bore 20 arranged to align with the blind bore 12. An insert 22 is located within the through bore 20, the first distance piece 18, insert 22 and end of the valve body 10 together defining a control chamber 24 within which a spring 26 is located, the spring 26 being engaged between the insert 22 and an end of the valve needle 16, and biasing the valve needle 16 into engagement with its seating.

The insert 22 includes a projection 22*a* which extends into the control chamber 24 and defines a lift stop arranged to limit movement of the valve needle 16. An axially extending drilling is provided in the projection 22*a* extending from an end thereof which faces the valve needle 16, the drilling defining a chamber 28 which communicates through a passage 30 with an annular chamber 32 defined between the insert 22 and the first distance piece 18. Flow of fuel through the passage 30 is restricted by a restriction or orifice 30*a*.

The end of the first distance piece 18 remote from the valve body 10 abuts a second distance piece 34, the first and second distance pieces 18, 34 together with the insert 22 defining a second annular chamber 36 which communicates with the first annular chamber 32 through a restricted annular edge filter 38 which is arranged to filter the flow of fuel between the first and second annular chambers 32, 36.

A recess 40 is provided in the end of the insert 22 remote from the valve needle 16 such that the insert 22 together with the second distance piece 34 define a chamber. The second distance piece 34 is provided with a pair of bores 35*a*, 35*b* which communicate with the chamber defined between the insert 22 and the second distance piece 34, a valve member 42 being slidable within the bore 35*a*. The valve 42 carries, at its end remote from the first distance piece 18, an armature 44 which is moveable under the influence of the magnetic field of a solenoid actuator assembly 46. The valve member 42 includes an enlarged diameter region 42*a* which is engageable with a conical seating formed around an end part of the bore 35*a* within which the valve member 42 is located, an adjacent part 48 of the valve member 42 being of reduced diameter so as to define an annular chamber. The annular chamber communicates through a passage 50 with the annular chamber 36 defined between the first and second distance pieces 18, 34 and the insert 22.

As illustrated in FIG. 1, the solenoid actuator arrangement 46 is housed within a nozzle holder 52, the nozzle body 10 and the first and second distance pieces 18, 34 being secured to the nozzle holder 52 by means of a cap nut 54. The nozzle holder 52, the first and second distance pieces 18, 34 and nozzle body 10 are all provided with bores which together define a high pressure fuel supply line 56 arranged to supply high pressure fuel to the annular gallery 14. A restrictor 58 is provided in the high pressure fuel line 56 within the first distance piece 18 to restrict the rate of fuel delivery to the annular gallery 14, and upstream of the restrictor 58, a restricted passage 60 is arranged to permit the supply of fuel from the high pressure fuel supply line 56 to the control chamber 24. Upstream of the restricted passage 60, a second restricted passage 62 is arranged to permit the supply of fuel from the high pressure fuel supply line 56 to the first annular chamber 32. The combination of the second restricted passage 62, passage 30 and orifice 30*a* provides a restricted flow path between the chamber 28 and the supply line 56.

The solenoid actuator assembly 46 comprises a generally cylindrical core member 64, and a cylindrical yoke 70, windings 66 being located between the core member 64 and yoke 70. The ends of the core member 64 and yoke 70 are substantially coplanar as illustrated most clearly in FIG. 2. The core member 64 includes a central passage within which a spring 68 is located, the spring 68 engaging an end of the valve member 42 biasing the valve member 42 into engagement with its seating.

As illustrated most clearly in FIG. 2, the surface of the armature 44 which faces the solenoid actuator assembly 46 is of annular, frusto-conical form such that the air gap between the inner edge of that surface of the armature 44 and the solenoid actuator assembly 46 is smaller than the air gap at the peripheral edge of the armature 44. The part of the valve member 42 which extends through the armature 44 is of conical form, the cone angle thereof matching that of the armature 44. It will be recognised, therefore, that when the solenoid actuator assembly 46 is energised to lift the valve member 42 from its seating, movement of the valve member 42 towards the solenoid actuator assembly 46 is limited by engagement between the valve member 42 and the core member 64, the armature 44 not coming into contact with the solenoid actuator assembly 46. The presence of a relatively small air gap between the armature 44 and solenoid actuator assembly 46 results in the force generated by the solenoid actuator assembly 46 being relatively large.

The material used for the valve member 42 is harder than the relatively soft core member 64, thus in the absence of an additional stop or movement limiter, movement of the valve member 42 is limited by engagement of the end thereof with the core member 64. In use, such engagement will initially result in deformation of the core member 64 until it is shaped to match the end of the valve member 42, whereon the engagement will be spread over a relatively large area.

In use, in the position illustrated in the accompanying drawings, high pressure fuel is supplied to the supply line 56 thus the annular gallery 14 and the control chamber 24 are filled with fuel at high pressure. The action of the high pressure of the fuel on the end of the valve needle 16 located within the control chamber 24 together with the action of the spring 26 thereon is sufficient to maintain the valve needle 16 in engagement with its seating against the action of the fuel pressure against the thrust surface 16*c* and any other angled surfaces of the valve needle 16 tending to lift the valve needle 16 from its seating. Further, the valve member 42 is held in engagement with its seating by the spring 68, the valve member 42 being substantially pressure balanced in this position as the diameter of the seating line is substantially equal to that of the bore 35*a*.

In order to commence injection, the solenoid actuator assembly 46 is energised to lift the valve member 42 from its seating. Such movement of the valve member 42 results in fuel flowing to a suitable low pressure drain from the control chamber 24 and chamber 28 at a rate greater than the rate of fuel flow into the control chamber 24 and chamber 28 through the restricted passages 60, 62, and hence in the fuel pressure within the control chamber 24 and chamber 28 falling.

The reduction in the fuel pressure within the control chamber 24 results in a reduction in the force applied to the end of the valve needle 16 resulting, subsequently, in the valve needle 16 being lifted from its seating, and hence in the commencement of injection.

The movement of the valve needle 16 away from its seating is sufficient to bring the end thereof into engagement with the projection 22*a* thus closing the end of the drilling defining the chamber 28. The flow of fuel from the control chamber 24 is thus terminated, the communication between the supply line 56 and the control chamber 24 through the restricted passage 60 resulting in the pressure within the control chamber 24 increasing to substantially the same pressure as the supply line 56. As the valve member 42 is lifted from its seating, the fuel pressure within the chamber 28, and hence the pressure applied to a central part of the end of the valve needle 16 remains at a relatively low level, and is insufficient to move the valve needle 16 towards the seating, even though part of the end of the valve needle 16 is exposed to the increased pressure within the control chamber 24.

In order to terminate injection, the solenoid actuator assembly 46 is de-energised, the valve member 42 moving under the action of the spring 68 into engagement with its seating. Such engagement terminates the flow of fuel from the passage 50, the communication between the supply line 56 and chamber 28 through the restricted passage 62, passage 30 and orifice 30*a* resulting in an increase in the fuel pressure within the chamber 28. Such an increase in fuel pressure together with the action of the spring 26 is sufficient to move the valve needle 16 against the action of the fuel pressure applied to the thrust surface 16*c* and other angled surfaces of the valve needle 16, such movement continuing until the valve needle 16 engages its seating whereon injection is terminated.

As illustrated in FIG. 2, the end of the drilling defining the chamber 28 is of relatively large diameter, hence when the valve needle 16 engages the projection 22*a*, a relatively large area of the end of the valve needle experiences the pressure within the chamber 28. A relatively small increase in fuel pressure within the chamber 28 is therefore necessary to cause movement of the valve needle 16, the relatively small pressure increase being experienced over a relatively large part of the end surface of the valve needle 16.

As the control chamber 24 is at high pressure before the valve member 42 is moved into engagement with its seating in order to terminate injection, the amount of fuel which must flow through the restricted passage 62 in order to result in movement of the valve needle 16 is relatively low thus termination of injection occurs rapidly after de-energisation of the solenoid actuator assembly 46.

It will be recognised that the operating characteristics of the injection nozzle are dependent upon a number of factors including the diameter of the end surface of the valve needle 16, the areas of the thrust surface 16*c* and other angled surfaces of the valve needle 16 against which fuel acts in order to lift the valve needle from its seating, and also the relative effective diameters of the restrictor 58 and restricted passages 60, 62. For example, if the effective flow restriction of the restrictor 62, passage 30 and orifice 30*a* is low then on de-energisation of the solenoid actuator assembly 46, the fuel pressure within the chamber 28 rises at a high rate. Thus movement of the valve needle 16 into engagement with its seating can be achieved rapidly, the reduction in effective restriction to flow having the disadvantage that when the valve member 42 is lifted from its seating, a greater amount of fuel will flow past the valve member 42 to the low pressure drain, fuel being able to flow to the valve member 42 from the supply line 56 through the restricted passage 62.

The provision of the edge filter 38 traps relatively large particles carried by the fuel, preventing such particles from reaching the valve member 42 thus such particles are prevented from jamming the valve member 42 in its open position. It will be recognised that if such jamming did occur, a situation may be achieved in which the valve needle 16 remains lifted from the seating, insufficient pressure being achieved in the chamber 28 to cause the valve needle 16 to move towards its seating. Clearly, therefore, it is important to ensure that particles which could cause such jamming of the valve member 42 are prevented from reaching the valve member 42 thus the provision of additional filter means in the form of the edge filter 38 is desirable.

The use of the insert 22 and first distance piece 18 to define the control chamber 24 enables the provision of a control chamber of small volume. Where the control chamber is of relatively large volume, the relatively large quantity of fuel therein can be compressed by a significant amount, thus accurate control of the valve needle may not be possible, the use of a small volume control chamber reducing this disadvantage.

I claim:

1. An injection nozzle comprising a valve needle engageable with a seating, the needle including a thrust surface to which fuel under pressure can be applied to apply a force to the needle to lift the needle away from the seating, the valve needle having a surface associated therewith arranged such that, when the needle occupies a fully lifted position, a first part of the surface is exposed to the fuel pressure within a control chamber whilst a second part of the surface is exposed to the fuel pressure within a second chamber, the control chamber communicating with a supply line through a first restricted passage, wherein the second chamber communicates with the supply line through a second restricted passage independent of the first restricted passage.

2. A nozzle as claimed in claim 1, wherein the second restricted passage comprises a pair of restrictions connected in series.

3. A nozzle as claimed in claim 2, further comprising valve means controlling communication between the second chamber and a low pressure drain, the valve means communicating with a passage connecting the restrictions of the second restricted passage.

4. A nozzle as claimed in claim 3, further comprising filter means located between the passage and the valve means.

5. An injection nozzle comprising a valve needle engageable with a seating, the needle including a thrust surface to which fuel under pressure can be applied to apply a force to the needle to lift the needle away from the seating, the valve needle having a surface associated therewith exposed to the fuel pressure within a control chamber, the fuel pressure within the control chamber being controlled by an electromagnetically actuated valve comprising a solenoid actuator having a core arrangement and an armature, an air gap being defined between the core arrangement and the armature, wherein the axial length of the air gap tapers from a maximum adjacent an edge of the armature to a minimum adjacent the centre thereof.

6. An injection nozzle as claimed in claim 5, wherein the valve further comprises a valve member extending through the armature and engageable with the core arrangement to define a lift stop.

7. An injection nozzle comprising a valve needle engageable with a seating, the needle including a thrust surface to which fuel under pressure can be applied to apply a force to the needle to lift the needle away from the seating, the needle having a surface associated therewith exposed to the fuel pressure within a control chamber, and a control valve having a valve member slidable within a bore, the valve member including a region of enlarged diameter which is engageable with a seating defined around an end part of the bore, and a region of reduced diameter upstream of the seating, the region of reduced diameter defining within the bore an annular chamber which communicates with a valve inlet port, the control valve being arranged to control communication between the control chamber and a low pressure drain, wherein when the needle occupies a fully lifted position, part of the surface of the needle is exposed to the fuel pressure within a second chamber, the control chamber communicating with a supply line through a first restricted passage and the second chamber communicating with the supply line through a second restricted passage independent of the first restricted passage.

* * * * *